US006554751B1

(12) United States Patent
Dannelly

(10) Patent No.: US 6,554,751 B1
(45) Date of Patent: Apr. 29, 2003

(54) BUTTOCKS EXERCISE DEVICE

(76) Inventor: Charlie S. Dannelly, 758 S. Plymouth Blvd., Los Angeles, CA (US) 90005

( * ) Notice: Subject to any disclaimer, the term of this patent is extended or adjusted under 35 U.S.C. 154(b) by 0 days.

(21) Appl. No.: 09/632,710

(22) Filed: Aug. 4, 2000

(51) Int. Cl.[7] ..... A63B 21/068

(52) U.S. Cl. ..... 482/96; 482/95; 482/101

(58) Field of Search ..... 482/95, 96, 70–72, 482/66, 142, 148, 92, 135, 907–8, 93–104, 133, 139

(56) References Cited

U.S. PATENT DOCUMENTS 5,762,590 A * 6/1998 St. Fleur et al. ..... 482/97
5,827,154 A * 10/1998 Gill ..... 482/97

* cited by examiner

*Primary Examiner*—Nicholas D. Lucchesi
*Assistant Examiner*—Lori Baker Amerson
(74) *Attorney, Agent, or Firm*—Joseph N. Breaux

(57) ABSTRACT

An exercise device that allows a user to specifically target exercise the buttocks and hip muscles without also targeting the thigh muscles. The device includes a frame, an adjustable user torso support assembly, and a slidable knee support assembly.

2 Claims, 4 Drawing Sheets

BUTTOCKS EXERCISE DEVICE

TECHNICAL FIELD

The present invention relates to exercise equipment and more particularly to a buttocks exercise device that is adapted to exercise the buttocks and hip muscles while minimizing exercise of the thighs; the buttocks exercise device including a frame including two parallel top bearing slide rails mounted to two parallel top frame rods and two parallel bottom frame rods, the top frame rods being oriented at an angle with respect to the bottom frame rods, the top bearing slide rails being oriented in parallel with the top frame rods; an adjustable user torso support assembly including a back support member positioned between the two top frame rods and pivotally mounted to the bottom frame rods at a bottom support member end by two front pivot assemblies and pivotally connected at a top support member end to a cross bar connected between the bottom frame members by an adjustable height support bar mechanism, the height of the adjustable height support bar mechanism being adjustable such that the angle of a center section of the back support member is orientable at a user selected angle with respect to the top bearing rods, the back support member including a pair of outwardly extending forearm supports that extend away from the center section of the back support member in a direction toward a higher end of the top bearing rails, each forearm support having a hand grip member extending away from an end thereof in a direction away from the bottom support rods; and a knee support assembly including a cushioned knee support rod extending between and slidably mounted to each of the two bearing slide rails with a linear bearing assembly such that the cushioned knee support is slidable between the back support member and the higher end of the top bearing rods; each linear bearing assembly including a lock mechanism for allowing a user to lock the cushioned knee support in a fixed position with respect to the back support member while getting on and off of the buttocks exercise device.

BACKGROUND ART

Many individuals enjoy sculpting their bodies by exercising specific muscle groups at different intensities so that the desired musculature is achieved. The buttocks and hips are areas of particular interest when it comes to body sculpting. Although it is desirable to exercise the buttocks and hips to achieve the desired shape, exercises that target these muscle groups often also exercise the thighs which can lead to undesirable large thighs. It would be a benefit, therefore, to have an exercise device that would allow a user to specifically target exercise the buttocks and hip muscles without also targeting the thigh muscles.

GENERAL SUMMARY DISCUSSION OF INVENTION

It is thus an object of the invention to provide a buttocks exercise device that includes a frame including two parallel top bearing slide rails mounted to two parallel top frame rods and two parallel bottom frame rods, the top frame rods being oriented at an angle with respect to the bottom frame rods, the top bearing slide rails being oriented in parallel with the top frame rods; an adjustable user torso support assembly including a back support member positioned between the two top frame rods and pivotally mounted to the bottom frame rods at a bottom support member end by two front pivot assemblies and pivotally connected at a top support member end to a cross bar connected between the bottom frame members by an adjustable height support bar mechanism, the height of the adjustable height support bar mechanism being adjustable such that the angle of a center section of the back support member is orientable at a user selected angle with respect to the top bearing rods, the back support member including a pair of outwardly extending forearm supports that extend away from the center section of the back support member in a direction toward a higher end of the top bearing rods, each forearm support having a hand grip member extending away from an end thereof in a direction away from the bottom support rods; and a knee support assembly including a cushioned knee support rod extending between and slidably mounted to each of the two bearing slide rails with a linear bearing assembly such that the cushioned knee support is slidable between the back support member and the higher end of the top bearing rails; each linear bearing assembly including a lock mechanism for allowing a user to lock the cushioned knee support in a fixed position with respect to the back support member while getting on and off of the buttocks exercise device.

Accordingly, a buttocks exercise device is provided. The buttocks exercise device includes a frame including two parallel top bearing slide rails mounted to two parallel top frame rods and two parallel bottom frame rods, the top frame rods being oriented at an angle with respect to the bottom frame rods, the top bearing slide rails being oriented in parallel with the top frame rods; an adjustable user torso support assembly including a back support member positioned between the two top frame rods and pivotally mounted to the bottom frame rods at a bottom support member end by two front pivot assemblies and pivotally connected at a top support member end to a cross bar connected between the bottom frame members by an adjustable height support bar mechanism, the height of the adjustable height support bar mechanism being adjustable such that the angle of a center section of the back support member is orientable at a user selected angle with respect to the top bearing rods, the back support member including a pair of outwardly extending forearm supports that extend away from the center section of the back support member in a direction toward a higher end of the top bearing rods, each forearm support having a hand grip member extending away from an end thereof in a direction away from the bottom support rods; and a knee support assembly including a cushioned knee support rod extending between and slidably mounted to each of the two bearing slide rails with a linear bearing assembly such that the cushioned knee support is slidable between the back support member and the higher end of the top bearing rods.

In a preferred embodiment, each linear bearing assembly includes a lock mechanism for allowing a user to lock the cushioned knee support in a fixed position with respect to the back support member while getting on and off of the buttocks exercise device.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
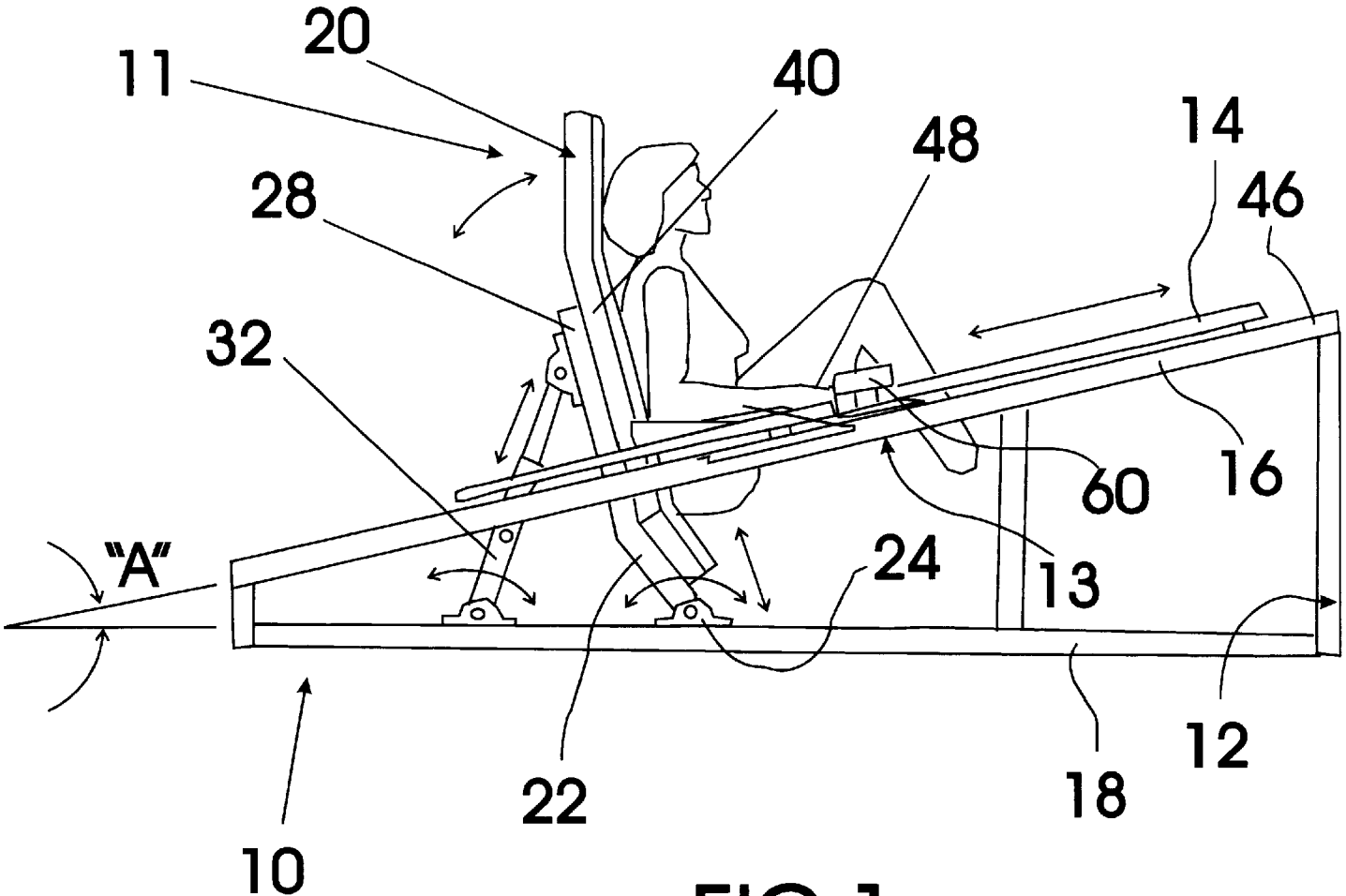
FIG. 1 is a is a side plan view of a representative user positioned on an exemplary embodiment of the buttocks exercise device of the present invention in the withdrawn position with the knees pulled forward toward the chest of the user and the buttocks lowered.
Figure 2:
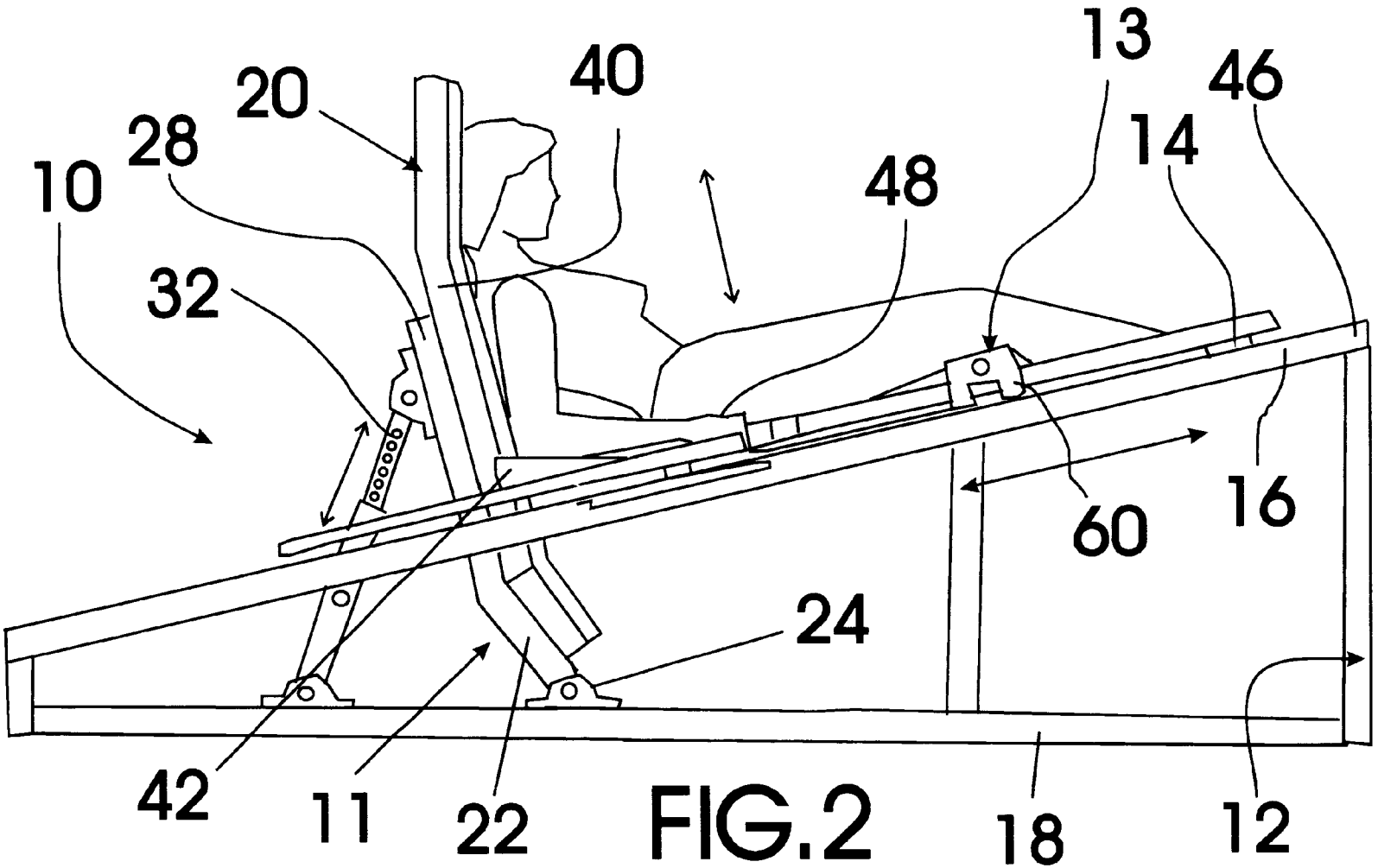
FIG. 2 is a side plan view of the representative user positioned on buttocks exercise device of FIG. 1 in the extended position with the knees pushed away form the chest of the user and the buttocks lifted.
Figure 3:
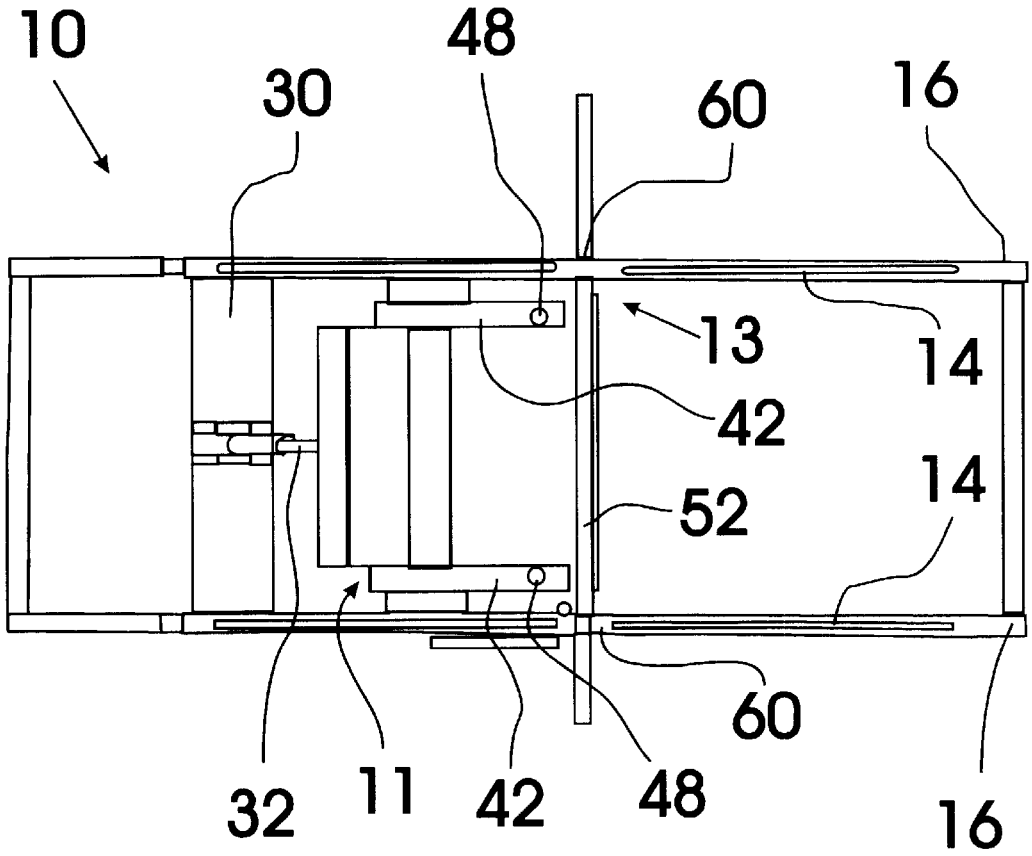
FIG. 3 is a top plan view of the buttocks exercise device of FIG. 1.
Figure 4:
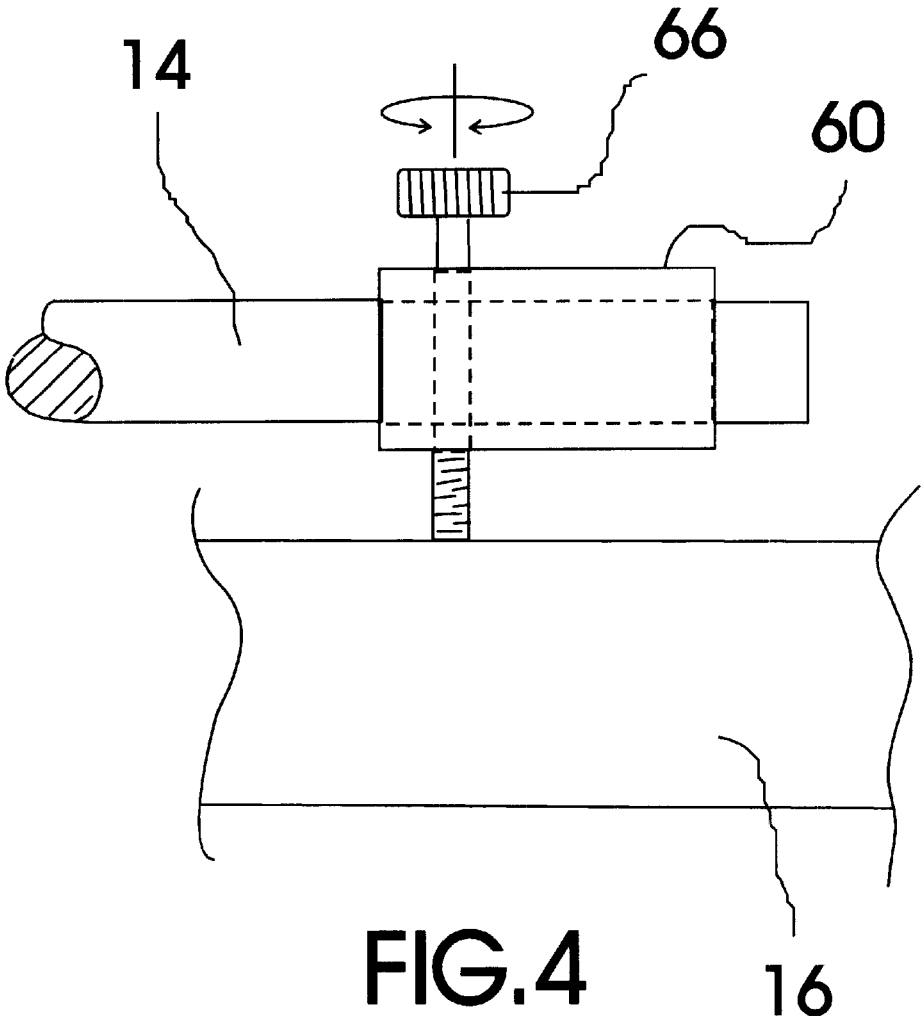
FIG. 4 is a detail plan view showing an exemplary screw down lock mechanism provided on the linear bearing for allowing a user to lock the cushioned knee support in a fixed position with respect to the back support member while getting on and off of the buttocks exercise device.

FIGS. 1–4 show various aspects of an exemplary embodiment of the buttocks exercise device of the present invention generally designated 10. Buttocks exercise device 10 includes a steel tubing frame, generally designated 12; an adjustable user torso support assembly, generally designated 11; and a knee support assembly, generally designated 13.

Frame 12 includes two parallel top bearing slide rails 14 rigidly mounted to two parallel top frame rods 16 and two parallel bottom frame rods 18. Top frame rods 16 are oriented at an angle "A" with respect to bottom frame rods 18. Top bearing slide rails 14 are oriented in parallel with top frame rods 16.

Adjustable user torso support assembly 11 includes a padded back support member, generally designated 20, positioned between the two top frame rods 16 and pivotally mounted to bottom frame rods 18 at a bottom support member end 22 by two front pivot assemblies 24 and pivotally connected at a top support member end 28 to a cross bar 30 connected between the two bottom frame members 18 by an adjustable height support bar mechanism 32. The length of the adjustable height support bar mechanism 32 is adjustable such that the angle of a center section 40 of back support member 20 is orientable at a user selected angle with respect to the top bearing rods 14. Back support member 20 includes a pair of outwardly extending forearm supports 42 that extend away from the center section of back support member 20 in a direction toward a higher end 46 of the top bearing rods 14. Each forearm support 42 has a hand grip member 48 extending away from an end thereof in a direction away from the bottom support rods 18.

Knee support assembly 13 includes a cushioned knee support rod 52 extending between and slidably mounted to each of the two bearing slide rails 14 with a linear bearing assembly 60 such that the cushioned knee support 52 is slidable between the back support member 20 and the higher end 46 of the top bearing rails 14.

In this embodiment, each linear bearing assembly 60 includes a screw down lock mechanism 66 for allowing a user to lock the cushioned knee support 52 in a fixed position with respect to the back support member 20 while getting on and off of the buttocks exercise device 10.

It can be seen from the preceding description that a buttocks exercise device has been provided.

It is noted that the embodiment of the buttocks exercise device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A buttocks exercise device comprising:

a frame including two parallel top bearing slide rails mounted to two parallel top frame rods and two parallel bottom frame rods, said top frame rods being oriented at an angle with respect to said bottom frame rods, said top bearing slide rods being oriented in parallel with said top frame rods;

an adjustable user torso support assembly including a back support member positioned between said two top frame rods and pivotally mounted to said bottom frame rods at a bottom support member end by two front pivot assemblies and pivotally connected at a top support member end to a cross bar connected between said bottom frame rods by an adjustable height support bar mechanism, the height of said adjustable height support bar mechanism being adjustable such that a center section of said back support member is orientable at a user selected angle with respect to said top bearing rods, said back support member including a pair of outwardly extending forearm supports that extend away from said center section of said back support member in a direction toward a higher end of said top bearing slide rods, each forearm support having a hand grip member extending away from an end thereof in a direction away from said bottom support rods; and a knee support assembly including a cushioned knee support rod extending between and slidably mounted to each of said two bearing slide rods with a linear bearing assembly such that said cushioned knee support is slidable between said back support member and said higher end of said top bearing rods.

2. The buttocks exercise device of claim 1 wherein each said linear bearing assembly includes a lock mechanism for allowing a user to lock said cushioned knee support in a fixed position with respect to said back support member while getting on and off of said buttocks exercise device.

* * * * *